United States Patent [19]

Gupta et al.

[11] Patent Number: 4,564,390

[45] Date of Patent: Jan. 14, 1986

[54] DECARBURIZING A METAL OR METAL ALLOY MELT

[75] Inventors: Debabrata Gupta, New Haven; John C. Yarwood, Madison, both of Conn.

[73] Assignee: Olin Corporation, New Haven, Conn.

[21] Appl. No.: 684,775

[22] Filed: Dec. 21, 1984

[51] Int. Cl.[4] ..... C21C 7/00

[52] U.S. Cl. ..... 75/51.7; 75/57

[58] Field of Search ..... 75/51, 57, 52, 60, 56, 75/59

[56] References Cited

U.S. PATENT DOCUMENTS

| | | | |
|---|---|---|---|
| 2,983,598 | 5/1961 | Wheatley | 75/56 |
| 3,046,107 | 7/1962 | Nelson et al. . | |
| 3,252,790 | 5/1966 | Krivsky . | |
| 3,754,892 | 8/1973 | Ando et al. . | |
| 3,893,917 | 7/1975 | Pryor et al. . | |
| 3,953,199 | 4/1976 | Michaelis . | |
| 3,962,081 | 6/1976 | Yarwood et al. . | |
| 4,024,212 | 5/1977 | Dore et al. . | |
| 4,139,184 | 2/1979 | Griffith | 266/220 |
| 4,472,195 | 9/1984 | Gupta et al. . | |

OTHER PUBLICATIONS

"Effect Of Impurities Of The Solubility Of Sulphur Dioxide In Molten Copper" By Floe et al., *AIME*, New York Meeting, Feb. 1942, vol. 147, pp. 28–29.

"Some Improvements For The Refractory Performance Of Twenty Ton AOD Vessel In Last Three Years" By Ishida et al., as reported in the Proceedings of Third International Iron And Steel Congress, 1978, pp. 150–157.

"Production Of Super Ferritic Stainless Steels By S.S.--VOD Process" By Kaito et al., as reported in the Proceedings of The Third International Iron and Steel Congress, 1978, pp. 594–608.

"Filtration Of Irons With Cellular Ceramic Filters" by Day et al. in Modern Casting, Apr., 1984.

"Transport Phenomena In Metallurgy" by Geiger et al., in the Addison-Wesley Series in Metallurgy and Materials, 1973.

*Primary Examiner*—Peter D. Rosenberg

*Attorney, Agent, or Firm*—Howard M. Cohn; Barry L. Kelmachter; Paul Weinstein

[57] ABSTRACT

A process is disclosed for reducing the carbon content of a melt of metal or metal alloy, carbon, and at least one strong oxide forming metallic alloying element from an initial value of about 0.1 wt % carbon to a final value of not less than about 0.003 wt % carbon. The process consists of contacting the melt with a reactive oxide of the metallic alloying element and simultaneously stirring the melt with an inert gas.

21 Claims, 4 Drawing Figures

DECARBURIZING A METAL OR METAL ALLOY MELT

While the invention is subject to a wide range of applications, it is especially suited for the decarburization of an alloy melt having a carbon content of less than about 0.1 wt % and will be particularly described in that connection.

This application relates to U.S. Pat. No. 4,472,195 entitled "Process for Decarburizing Alloy Melts" by Gupta et al. and U.S. patent application Ser. No. 523,328 entitled "Process of Continuously Treating An Alloy Melt" by Tyler et al. filed Aug. 15, 1983 and having a common assignee.

The removal of impurity carbon in the range of ≦0.1 wt. % from ferrous or non-ferrous melts that contain substantial amounts of oxidizable metallic elements, e.g. chromium, occurs in accordance with the following chemical reaction:

$$M_xO_y + y\,\underline{C} \rightarrow x\,\underline{M} + y\,CO$$

where, $M_xO_y$ is the oxide of metal M in the molten alloy;

$\underline{C}$ is the dissolved carbon which reacts with the metal oxide;

CO is the carbon monoxide in the form of gas bubbles that rise from the melt, and $\underline{M}$ is reduced metal that reverts into solution in the melt.

The underlying thermodynamics of this basic reaction are well understood for applications of industrial significance (e.g. stainless steel making) and have been successfully applied to processes, e.g. the argon oxygen decarburizing (AOD) process for producing lower carbon stainless steels, as described in U.S. Pat. No. 3,252,790 to Krivsky.

Irrespective of specific applications, the decarburization processes for removal of undesirable carbon from ferrous and non-ferrous melts are characterized by two problems in the low carbon (≦0.1 wt. %) range. Firstly, the carbon removal rate (the decarburization rate) rapidly drops off as the carbon content of melt is reduced. For example, at a carbon level of 0.5 wt %, the decarburization rate by the typical Argon Oxygen Decarburization (AOD) practice for stainless steels is 0.02 wt % C/min. This rate drops to under 0.003 wt % C/min as the decarburization progresses to a level of less than 0.1 wt % C. Secondly, there is a rising loss of valuable metallics, e.g. Cr, Mo, W, by oxidation as the carbon content falls below 0.3 wt %. For example, in typical AOD practice at carbon levels below 0.1 wt %, up to 6 wt % of the original Cr charge is removed from the melt by oxidation.

A discussion of these problems and current industrial applications of the AOD process is described in an article entitled "Some Improvements For The Refractory Performance of Twenty Ton AOD Vessel In Last Three Years" by Ishida et al., as reported in the Proceedings of Third International Iron and Steel Congress, 1978, pages 150–157. In the AOD process described therein, inert gases, e.g. argon, nitrogen, were mixed with oxygen and injected through horizontal tuyeres submerged in the melt contained in a batch type converter vessel. Acceptable decarburization rates in conjunction with minimum chromium loss were obtained by proper control of the inert gas/oxygen ratio.

At present, there is no single process for simultaneously eliminating both of the above mentioned problems inherent in the thermochemistry of the decarburization process. However, the SS-VOD process as described in an article entitled "Production of Super Ferritic Stainless Steels by S.S. - VOD Process" by Kaito et al., as reported in the Proceedings of the Third International Iron and Steel Congress, pages 594–608 (1978) successfully produces ultra low carbon stainless steels. Using this process, the loss of metallic chromium by oxidation is insignificant since the decarburizing process occurs in an evacuated chamber while bubbling an inert gas through the melt. However, the best decarburization rates for about 0.1 and 0.015 wt % carbon in 16% Cr steels are at only about 0.005 and 0.002 wt % C/min, respectively. These rates require about 20 to 30 minutes to reduce carbon levels from about 0.1 to about 0.01 wt % with the SS-VOD process. As expected, the time required to decarburize from 0.01 down to 0.001% is even longer, about 50 minutes.

Existing batch techniques, e.g. AOD or the SS-VOD processes in their present configuration, are not amenable to transformation into continuous refining operations. This is particularly the situation in the low throughput regimes of below about 10 tons per hour. The engineering of a practical rapid continuous decarburization process that operates under vacuum, with provisions for melt inlet and outlet is uneconominal. Straightforward implementation of an AOD type scheme, for continuous processing at low throughputs with the melt exposed to the ambient, has several limitations including the method of introducing and contacting the reactant gases into the flowing melt and the difficulties of recovering oxidized chromium from the slag without additional facilities.

There are numerous specific processing steps for decarburizing metals as disclosed in U.S. Pat. Nos. 3,046,107, 3,754,892, and 3,953,199.

It is a problem underlying the present invention to provide a process for decarburizing a melt of very low carbon content metal or metal alloy which occurs very rapidly and with reduced loss of alloying metallics.

It is an advantage of the present invention to provide a process for decarburizing a melt of metal or metal alloy which obviates one or more of the limitations and disadvantages of the described prior processes.

It is a further advantage of the present invention to provide a process for decarburizing a melt of metal or metal alloy which can be carried out in either batch or continuous modes.

It is a further advantage of the present invention to provide a process for decarburizing a melt of metal or metal alloy which can be accomplished very rapidly and with reduced loss of valuable alloying metallics.

Accordingly, there has been provided a process for reducing the carbon content of a melt of metal or metal alloy, carbon, and at least one strong oxide forming metallic alloying element from an initial value of about 0.1 wt % carbon to a final value of not less than about 0.003 wt % carbon. The process consists of contacting the melt with a reactive oxide of the metallic alloying element and simultaneously stirring the melt with an inert gas.

The invention and further developments of the invention are now elucidated by means of the preferred embodiments in the drawings.

The present invention is concerned with the process of decarburizing a metal or metal alloy melt which will absorb carbon. The melt may be comprised of nickel and ferrous alloys but can include other alloying metallic materials, such as for example, cobalt, silicon, chromium, aluminum, molybdenum and manganese.

Figure 1:
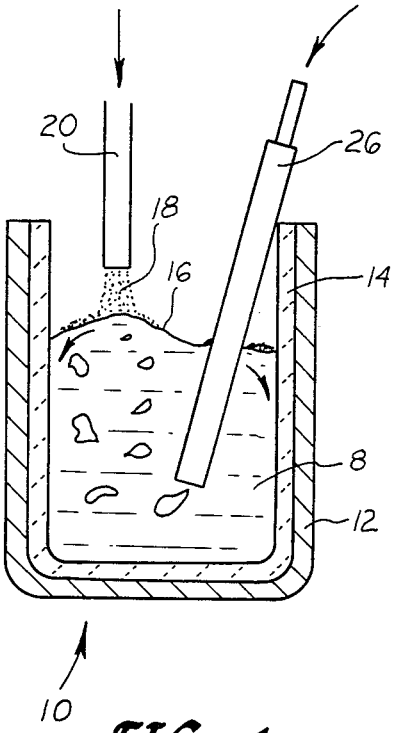
FIG. 1 is a schematic representation of a first embodiment for batch decarburization in accordance with the present invention.

While various types of apparatus might be utilized in carrying out the invention, the reactor illustrated in FIG. 1 may be utilized to describe typical batch processing. The reactor 10 may be comprised of a steel vessel 12 lined with refractories 14. The specific refractories are chosen to insulate the vessel so as to provide thermal efficiency. They also resist melt and slag attack of the vessel which act to degrade the vessel and the melt being treated. Preferably, the refractory is inert to the particular melt within the reactor. Factors such as thermal efficiency, reactivity of materials and the cost must all be considered in selecting the most suitable refractory lining.

The decarburizing process of the present invention is particularly directed to melts having a carbon content of less than or equal to about 0.1 wt %. The carbon content of the melt is reduced from its initial value to a final value of not less than about 0.003 wt % carbon. The final amount of carbon desired in the melt is determined by the specific application for which the melt is to be applied.

The decarburizing is accomplished by contacting the metal or metal alloy melt 8 with a reactive oxide 18 of the metallic alloying element. The decarburizing agent is selected to be an oxide of a strongest oxide forming metallic alloying element which is provided in the melt. In the event that there are several strong oxide forming metallic alloying elements, in addition to thermodynamic and chemical kinetic considerations, factors such as the cost of the metallic element come into play in determining which would be selected for use in carrying out the present invention. For example, if both chromium and aluminum were present in the melt, a chromium oxide in powder form would probably be selected since the loss of chromium from the melt due to its oxidation would be a more significant economic loss than the loss of aluminum due to its oxidation. The decarburizing agent is preferably selected from oxides of the group consisting of chromium, molybdenum, manganese, vanadium, niobium, silicon, titanium, zirconium, magnesium and aluminum. However, it is within the terms of the present invention to select the reactive oxide from any metallic alloying element which would enable one to carry out the process of the present invention.

Once the reactive oxide of the metallic alloying element is selected, it may be applied to the melt in powder form using any number of conventional techniques. For example, FIG. 1 illustrates the reactive oxide powder 18 being added to the melt surface 16. The powder may be delivered through delivery tube 20 so as to substantially cover the surface of the melt. If desired, two or more delivery tubes may be used in order that the reactive oxide powder sufficiently covers the melt.

Concurrent with the application of the powder 18 of a reactive oxide of metallic alloying element, the melt is stirred. The process step of stirring may be accomplished by injection of an inert gas, such as for example argon or nitrogen into the melt. The gas bubbles rise up and stir the melt while simultaneously driving fresh melt to the melt surface 16 for contacting the reactive oxide powder 18 disposed thereon. The gas may be discharged into the melt by any conventional technique such as a lance 26, a sparge ring or a porous plug disposed in the bottom surface of the vessel.

Figure 2:
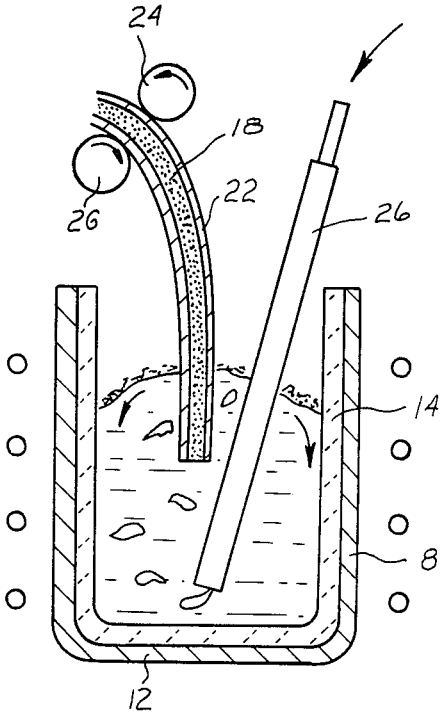
FIG. 2 is a schematic representation of a second embodiment for batch decarburization in accordance with the present invention.

A second embodiment, as shown in FIG. 2, introduces loosely packed reactive oxide powder 18 in a consumable metal feed tube 22 into the bulk of the melt 8. The tube would be continuously fed into the melt at a desired speed by feed wheels 24 and 26. Other techniques for injecting the oxidized powder include injecting the reactive oxide of the alloying element in a powder form with a carrier gas. The carrier gas is substantially inert and may be either argon or nitrogen. Also, a feed wire or rod constructed of the reactive oxide and if necessary shrouded with a gas such as nitrogen or argon in a tube may be fed into the melt. Other techniques include injecting a powder or a feed wire with a flux or slag coating and shooting slugs of the oxidized alloying element directly into the melt.

Figure 3:
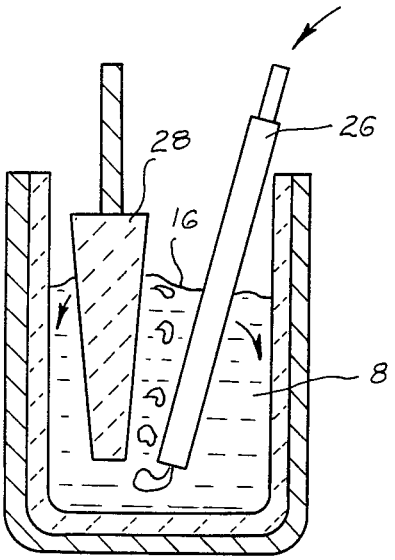
FIG. 3 is a schematic representation of a third embodiment for batch decarburization in accordance with the present invention.

A third embodiment of the present invention, as shown in FIG. 3, consists of immersing at least one porous block or agglomerate containing a reactive oxide of the metallic alloying element. The block is preferably formed of a porous ceramic material containing up to 100% of a reactive oxide of the metallic alloying element. Oxides which are more readily reduced by the melt may be used in the formulation of the porous block. However, these oxides should not be present in a quantity or form which leads to their reduction in preference to the above mentioned reactive oxide of the metallic alloying element. The porous block may be formed of any desired ceramic material, such as alumina, zirconia, magnesia, silica, chromia and combinations thereof. The block may be constructed of a ceramic foam or a ceramic extruded honeycomb as disclosed in U.S. Pat. Nos. 3,893,917, 3,962,081, and 4,024,212. Both the honeycomb and the foam preferably contain the reactive oxide as a major constituent. However, this block may be constructed of any suitable refractory material coated with a reactive oxide of the metallic alloying element used as a powder in the first and second embodiments of the invention. By providing a relatively porous surface, more surface area is in contact with the melt. The pore size of the block is selected to optimize the surface area of the melt with which it is in contact.

It should be noted, that as the melt comes into contact with the reactive oxide contained in the porous block, the reactive oxide is consumed so that a fresh reactive oxide surface is constantly brought into contact with the melt.

As in the first two embodiments of the invention, stirring insures that fresh melt is always in contact with the ceramic block. The stirring is preferably accomplished with injected inert gas through a lance 26 as illustrated. It is, however, within the terms of the present invention to substitute other conventional apparatus such as a sparge ring or porous plug in the bottom of the reactor vessel as described in connection with the embodiments illustrated in FIGS. 1 and 2. Although the melt may actually flow through the ceramic block, it is also within the terms of the present invention that the melt only contacts the surface of the block which is optimized in area by its roughened surface. When the block is inserted within the melt, it is preferably preheated to above about 1200° C. to prevent freezing of the metal it contacts. Below this temperature, a solid skin of metal forms around the ceramic block. This skin initially prevents the melt from contacting the reactive metallic oxide of the block.

The process of the present invention was demonstrated in decarburizing a low carbon (less than 0.1 wt %) nickel base alloy containing about 16 & chromium. Approximately 10 pounds of the melt was induction melted in a magnesia crucible of the type illustrated in FIGS. 1–3. The temperature of the melt was approximately 1630°–1650° C. In about 10 minutes, the carbon level was reduced to 0.01 wt % by immersing into the bulk of the melt six metal foil pouches about every 1–2 minutes. Each pouch contained about 4 gm of $Cr_2O_3$ which was stirred into the melt by injecting 3 liters per minute of argon through a submerged lance. Other tests indicated that one time addition of a large excess of chrome oxide resulted in poorer reaction rates due to balling up of the oxide. Therefore dispersed and continuous addition of the oxide appears necessary for process optimization.

Using the apparatus of FIG. 3, approximately 175 grams of alumina ceramic blocks with a porosity in excess of about 95% and containing about 15 wt % chromium oxide were preheated to about 1200° C. The blocks were then immersed into 10 pounds of chromium bearing non-ferrous melt initially containing about 0.07 wt % carbon. Simultaneously, the melt was stirred by injecting three liters per minute of argon gas with a submerged lance. A vigorous decarburization reaction ensued and a carbon level of about 0.004 wt % was reached in less than 7 minutes, indicating an average decarburization rate of approximately 0.001 wt % carbon per minute.

Figure 4:
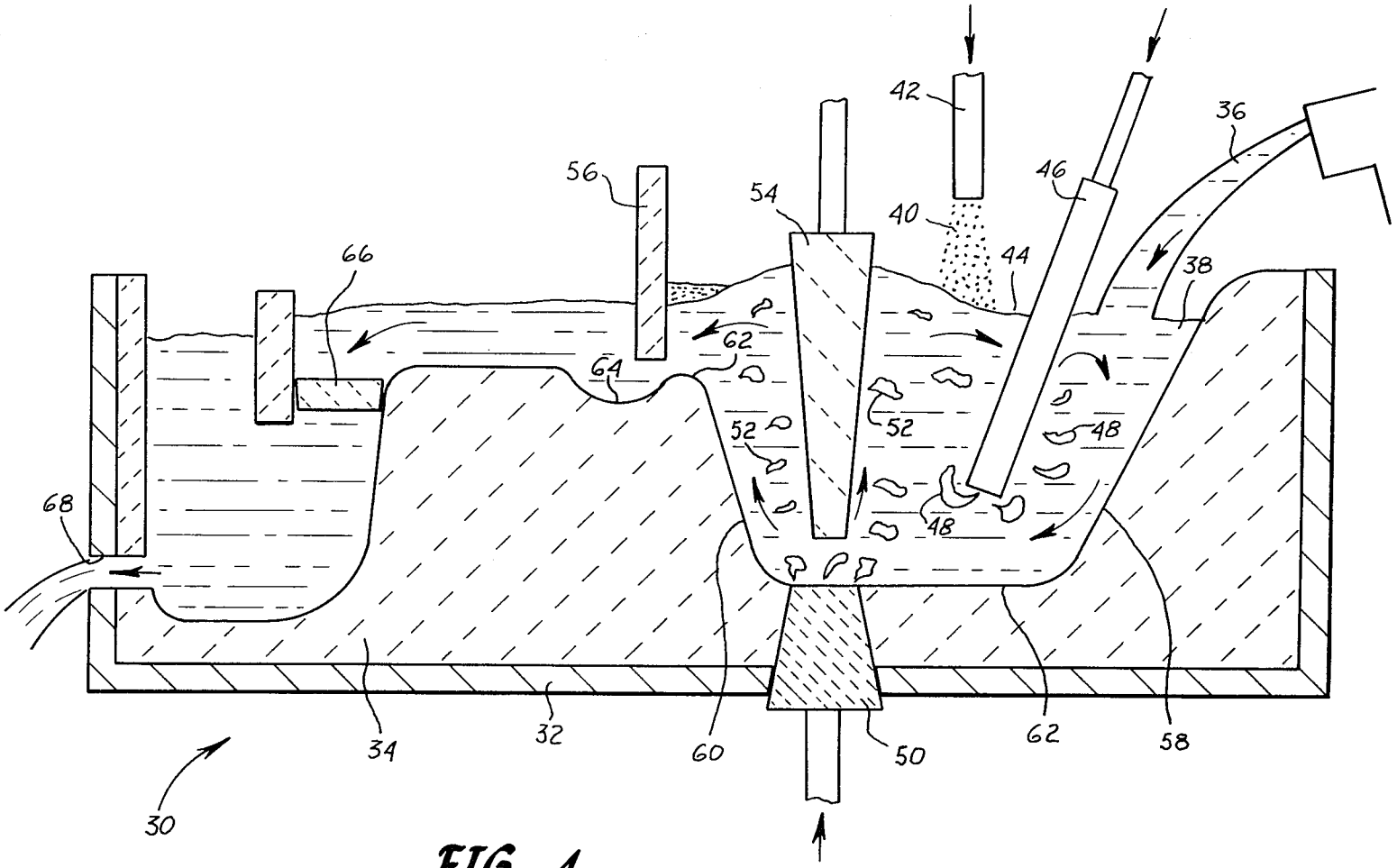
FIG. 4 is a schematic representation of a continuous decarburization system for processing a melt in accordance with the present invention.

The fourth embodiment of the present invention provides a continuous decarburization process as illustrated in FIG. 4. A suitable continuous reactor 30 may be constructed of a steel shell 32 with a refractory lining 34 similar to the lining of the embodiments illustrated in FIGS. 1–3. The metal or metal alloy melt 36 is of the type described with respect to melt 8 of FIGS. 1–3. The melt may be poured by any conventional means into the chamber 38. The process requires a reactive oxide of a strong oxide forming metallic element found in the melt to contact the metal or metal alloy melt. This may be achieved by the discharge of a powder 40 of a reactive oxide through a delivery tube 42 onto the surface of the melt. Although one delivery tube is illustrated, any number of delivery tubes may be used in order that enough powder is delivered to substantially cover the melt surface 44.

In addition to the powder, a porous ceramic block or agglomerate 54, substantially the same as the porous block 28 of the embodiment illustrated in FIG. 3, may be immersed in the melt. This block is formed of a porous ceramic material containing up to 100% of a reactive oxide of the metallic element. As described hereinabove, the block structure may also be constructed of any suitable refractory material which is substantially coated with the same oxide of the metallic alloying element used as powder 40. The ceramic block or agglomerate may be selectively employed together with or in place of the powder covering the surface of the melt. Although the porous block is illustrated, it is also within the terms of the present invention to introduce a reactive oxide powder into the bulk of the melt in accordance with the principles of the embodiment of FIG. 2. For example, the powder can be loosely packed in a consumable metal feed tube and fed into the melt as the tube disintegrates and the powder disperses. The addition of a powder directly into the bulk of the melt may be employed independently or in conjunction with one or both of the two techniques described above, i.e. covering the top of the melt surface with the reactive oxide powder and immersing a ceramic block containing the reactive oxide element into the melt. The melt contact with the reactive oxide powder on surface 44 and the reactive oxide in the porous block reduces the carbon content of the melt to a value as low as about 0.001 wt % carbon.

Simultaneously, the melt is stirred by injecting an inert gas such as argon or nitrogen below the surface of the melt. This may be accomplished by any number of means such as a lance 46 or other conventional gas delivering systems such as a porous plug 50 or sprage ring. Any of the gas delivery means may be used alone or in combination with other gas delivery systems. The plumes of the inert bubbles 48 and 52, from the lance 48 and plug 50 respectively, rise up through the melt and cause a stirring action as indicated by the arrows. Fresh melt is brought up to the surface 44 where it contacts the reactive oxide powder 40 of the metallic alloying element as well as the block 54.

The reactor vessel is preferably designed of a geometry to maximize the gas stirring and thereby enhance the operation conditions of the process. For example, the inner walls 58 and 60 of the reactor are sloped outwardly to provide a larger stirring area closer to the top surface 44 of the melt as compared with the bottom surface 62.

A flow limiting weir 56 is disposed downstream from the chamber 38. This weir prevents the reactive oxide powder of the metallic alloying element from floating downstream and thereby forming deleterious inclusions. The vessel 30 further has a refractory 34 wherein downstream of the top surface 62 of the wall 60, the refractory dips downward to form a bottom surface 64. The weir 56 is placed slightly downstream from the high point 62 to improve the melt flow towards the melt surface 44 in the chamber 38 without creating a dead zone, i.e. where no stirring occurs.

The melt then continues to moves downstream and may flow through a porous block 66 which can be of any conventional design such as a plate filter formed of a ceramic porous block and containing a reactive oxide of the metallic alloying element used as the powder 40. This porous block may be formed in any desired means in accordance with the principles described in conjunction with the porous block of the third embodiment described hereinabove. It can be formed as a ceramic foam or a ceramic extruded honeycomb. Examples of cellular materials of this type are disclosed in an article entitled "Filtration of Irons with Cellular Ceramic Filters" by Day et al. in Modern Casting, April 1984. The advantage of using a porous block coated with the reactive oxide is that the carbon content of the material may be reduced even further. The reactive oxide will be consumed by contact with the melt and provisions for replacement of the porous block will be required.

Finally, the melt passes through an outlet 68 where it can be delivered to any desirable device such as a continuous casting apparatus.

An important aspect of the treatment is the residence time of the melt in the treatment zones within the reactor 30. The reactor sections must, therefore, be sized to provide sufficient residence time to allow the reaction or refinement operation to proceed to the extent required. Residence time requirements will accordingly depend on inlet impurity content, outlet refinement requirements and melt chemistry.

The concepts of this invention have been successfully applied to continuous decarburization in the reaction vessel designed to optimize the decarburization rate, heat loss and chromium oxidation. The method of chromium oxide addition was by continuous spraying of chromium oxide powder on the free surface of the melt. Fresh melt was continually exposed to the chrome-oxide powder by submerged injection of argon gas bubbles through porous refractory block at the bottom of the reaction vessel. The internal contour of the vessel, similar to that illustrated in FIG. 4, was designed to obtain a well mixed melt flow in the reaction zone. Fresh carbon bearing melt was continually added at the upstream end of the vessel. After decarburization, the melt was discharged over a flow limiting weir.

Metal was decarburized at the rate of 15 pounds per minute through the vessel having a 75 pound capacity. Beginning with an inlet content of 0.047 wt %, an outlet carbon level of 0.035 wt % was obtained. The equivalent decarburization rate at this outlet carbon level for the operating conditions was about 0.004% C/min. and the Cr loss was about 3 wt %. This represents a 50% improvement over the rates encountered in standard SS-VOD practice.

The patents and publications set forth in this application are intended to be incorporated by reference herein.

It is apparent that there has been provided in accordance with the present invention a process for decarburizing a metal or metal alloy melt which fully satisfies the objects, means and advantages set forth hereinabove. While the invention has been described in combination with the embodiments thereof, it is evident that many alternatives, modifications and variations will be apparent to those skilled in the art in light of the foregoing description. Accordingly, it is intended to embrace all such alternatives modifications and variations as fall within the spirit and broad scope of the appended claims.

We claim:

1. A process for decarburizing a melt of metal or metal alloy, comprising the steps of:

(a) providing a melt comprising metal or metal alloy, carbon, and at least one oxide forming metallic alloying element;

(b) reducing the carbon content of the melt from an initial value of about 0.1 wt % carbon to an a final value of not less than about 0.003 wt % carbon by:

i. contacting the metal or metal alloy melt with a reactive oxide of said metallic alloying element; and ii. simultaneously stirring said melt by injecting an inert gas below the surface of the melt.

2. The process of claim 1 wherein said reactive oxide of said alloying element is selected from oxides of the group consisting of chromium, manganese, vanadium, niobium, silicon, titanium, zirconium, magnesium, molybdenum, and aluminum.

3. The process of claim 2 wherein said reactive oxide of said alloying element is chromium oxide.

4. The process of claim 1 wherein said step of contacting said melt with a reactive oxide of said alloying element comprises the step of disposing a powder of the reactive oxide on the surface of the melt.

5. The process of claim 4 wherein said step of disposing a powder further comprises substantially covering the surface of the melt with the powder.

6. The process of claim 1 wherein said step of contacting said melt with a reactive oxide of said alloying element comprises the step of injecting the reactive oxide in powder form below the surface of the melt.

7. The process of claim 1 wherein the step of contacting said melt with a reactive oxide comprises the step of immersing a ceramic porous block containing said reactive oxide of said alloying element within said melt.

8. The process of claim 7 wherein the ceramic of said porous block is selected from the group comprising chromia, alumina, zirconia, magnesia, silica and combinations thereof.

9. The process of claim 8 wherein said porous block is a ceramic foam.

10. The process of claim 8 wherein said porous block is a ceramic extruded honeycomb.

11. The process of claim 8 wherein said porous block is a refractory material coated with the reactive oxide of said alloying element.

12. The process of claim 2 wherein said inert gas is selected from the group comprising argon and nitrogen.

13. The process of claim 12 wherein said melt is a nickel base alloy.

14. The process of claim 12 wherein said melt is an iron base alloy.

15. The process of claim 12 wherein said final value is not less than about 0.01 wt % carbon.

16. The process of claim 1 including the step of filtering said melt having a carbon content with a final value through a second ceramic porous block containing said reactive oxide of said alloying element with said melt.

17. The process of claim 16 wherein the ceramic of said second porous block is selected from the group comprising chromia, alumina, zirconia, magnesia, silica and combinations thereof.

18. The process of claim 17 wherein said porous block is a ceramic foam.

19. The process of claim 17 wherein said porous block is a ceramic extruded honeycomb.

20. The process of claim 17 wherein said porous block is a refractory material coated with the reactive oxide of said alloying element.

21. The product in accordance with the process of claim 1.

* * * * *